United States Patent [19]

Provost et al.

[11] Patent Number: 4,553,421

[45] Date of Patent: Nov. 19, 1985

[54] RING COMPRESSOR TOOL

[75] Inventors: Lawrence A. Provost, Warren; Robert D. Boyer, Ferndale, both of Mich.

[73] Assignee: Sealed Power Corporation, Muskegon, Mich.

[21] Appl. No.: 605,057

[22] Filed: Apr. 30, 1984

[51] Int. Cl.[4] ..... B21D 41/04

[52] U.S. Cl. ..... 72/402; 29/283.5; 72/409; 72/454

[58] Field of Search ..... 29/222, 224, 229, 283.5; 72/402, 454, 478, 476, 409

[56] References Cited

U.S. PATENT DOCUMENTS

| | | | |
|---|---|---|---|
| 3,289,287 | 12/1966 | Guritz | 29/283.5 |
| 3,834,011 | 9/1974 | Pinkerton | 29/283.5 |
| 4,043,172 | 8/1977 | Schmittou | 72/402 |

*Primary Examiner*—W. D. Bray

*Attorney, Agent, or Firm*—Barnes, Kisselle, Rasich, Choate, Whittemore & Hulbert

[57] ABSTRACT

This invention relates to a tool for uniformly compressing a non-resilient metal ring to a smaller diameter which comprises an outer hollow receiver provided with a handle for manually holding the receiver against turning, a threaded shaft in the receiver which at its one end within the receiver has rotatably mounted thereon a collet which upon being drawn into the receiver by rotation of the threaded shaft causes the fingers of the collet by engagement with the inner wall of the receiver to move inwardly or toward each other to thereby uniformly compress to a smaller diameter a metal ring mounted in the ends of the collet fingers.

4 Claims, 6 Drawing Figures

RING COMPRESSOR TOOL

This invention relates to a tool for uniformly compressing a non-resilient metal ring to a smaller diameter.

BACKGROUND AND SUMMARY OF THE INVENTION

Many automobiles currently come equipped with air springs. These air springs are commonly used in automobiles to supplement the conventional shock absorbers. One form of conventional air spring includes an inflatable air sleeve of flexible air-tight material surrounding the shock absorber cylinder. The sleeve at each end has an air-tight seal with the cylinder.

The present invention relates to a tool which uniformly compresses a non-resilient metal ring to a smaller diameter. The air-tight seal between the cylinder and the air sleeve can be effected by the use of this tool. A non-resilient ring having an original diameter sufficient to be slipped over the end of the air sleeve which surrounds the cylinder is uniformly compressed to a smaller diameter by this tool to effectively clamp the air sleeve to the cylinder.

It is an object of this invention to produce a manually operable hand tool for uniformly compressing a non-resilient metal ring to a smaller diameter which is easily operated, simple in structure, and inexpensive to produce.

DESCRIPTION

Figures 1, 4, 5:
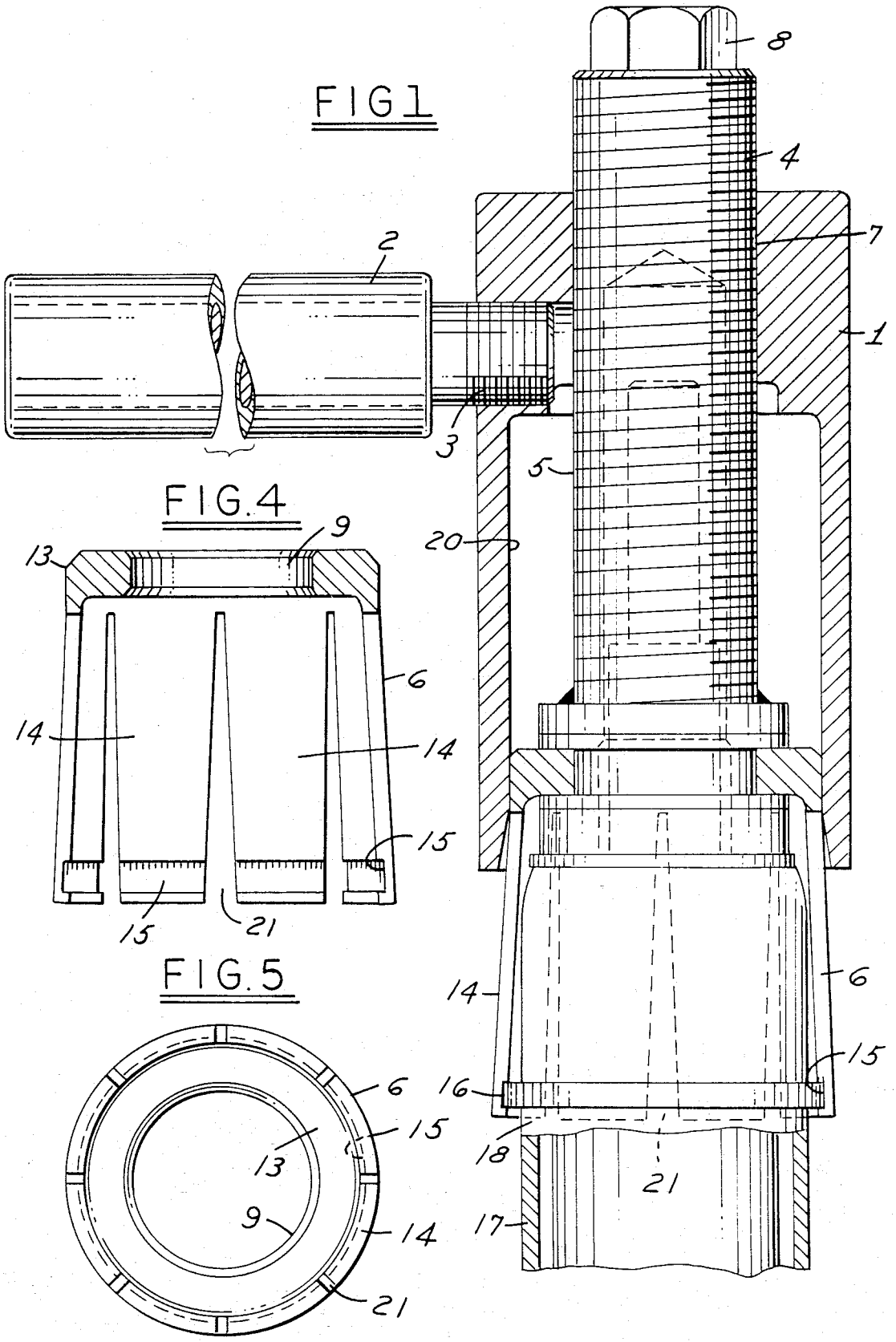
FIG. 1 is a view partly in section showing the compressor tool with the ring to be compressed in place and the tool ready for the compressing operation.
FIG. 4 shows the collet or cup which receives the ring to be compressed.
FIG. 5 is an end view of the collet or ring receiving cup in the closed position.

The tool as shown in FIG. 1 comprises a cup-like receiver 1 provided with a handle 2 which is threaded into an opening in the side wall of the receiver as at 3, a shaft 4 provided with an external thread 5 throughout its length, and a cup or collet 6 rotatably coupled to the shaft 4. The shaft has a threaded or screw fit in an opening 7 in the end of the receiver and is provided with a hexagonal outer end 8 for the reception of a wrench or other tool for turning the shaft.

Shaft 4 is journaled in an opening 9 in the collet 6. The shaft 4 is provided with a flange 10 at one end. The collet 6 is rotatably mounted on the shaft 4 and retained thereon between a flange 10 on the end of the shaft and a nut 11 threaded on the shaft 4. Thrust bearings 12 are provided between the flange 10 and the nut 11 on opposite sides of the head 13 of the collet so that the collet is free to rotate with respect to the shaft 4.

The collet 6 consists of a head 13 and a plurality of circumferentially arranged spring fingers 14 which are uniformly spaced or arranged around the head 13. The fingers are grooved at the outer ends as shown at 15 for reception of the ring 16 which is to be compressed.

The tube of a shock absorber, e.g., is designated 17 and the flexible sleeve which is to be clamped thereto is designated 18.

In operation or use the workman first places the metal ring to be compressed such, for example, a steel ring 16, in the collet groove 15. The collet at this time is in the position shown in FIG. 1 where the collet is adjacent the outer end of the receiver 1 and the collet fingers 14 are in their wide open position substantially without the receiver 1. While holding the tool by the handle 2 to prevent rotation of the receiver 1, the workman applies a wrench or other suitable tool 19 to the hexagonal head 8 and rotates the shaft 4 to draw the collet inwardly of the receiver 1.

Figure 2:
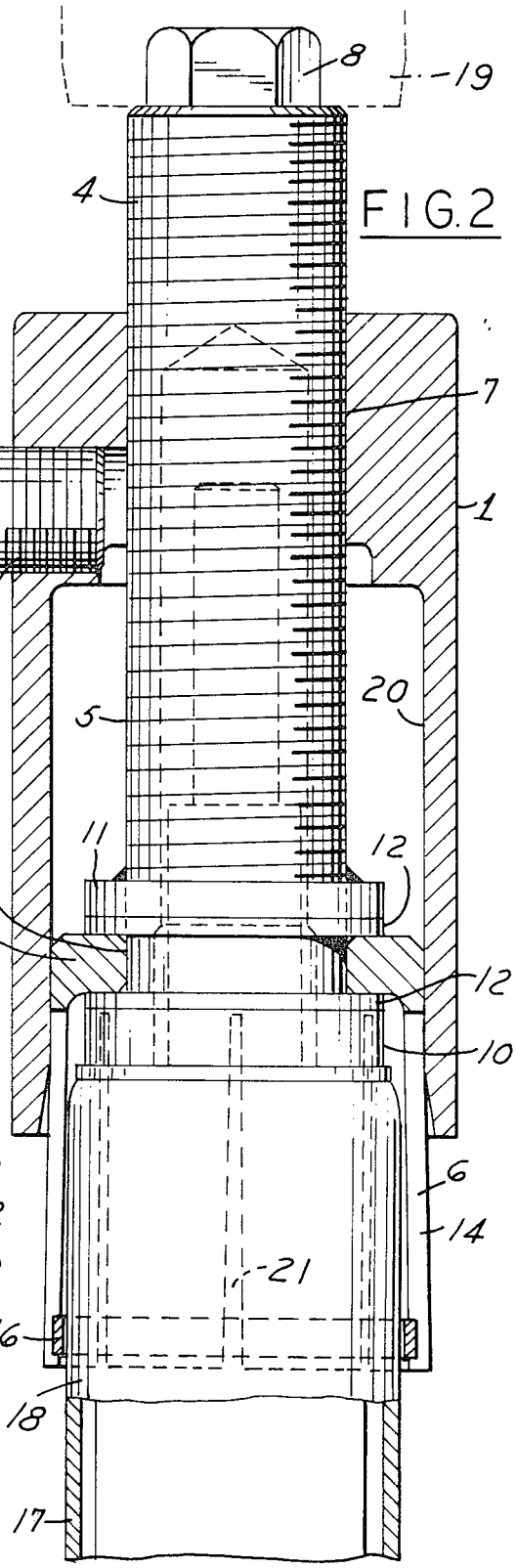
FIG. 2 is a view similar to FIG. 1 but showing the position of the parts of the tool after it has been operated to partially compress the metal ring.
Figure 3:
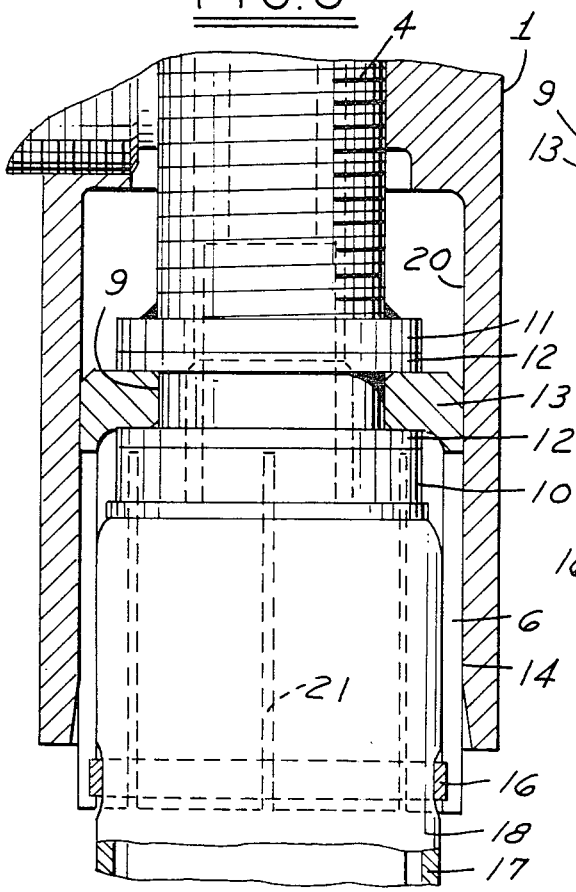
FIG. 3 shows the position of the parts of the tool at the end of the compressing operation.

In FIG. 2 the collet is shown partially withdrawn into the receiver 1 and in FIG. 3 the collet is shown fully withdrawn into the receiver 1. As the collet is drawn into the receiver 1 by rotation of the threaded shaft 4, the fingers 14 of the collet are forced inwardly or toward each other by the inner wall 20 of the receiver 1 thus decreasing the spaces or gaps 21 between the fingers 14 as shown in FIGS. 1 and 3. The inner wall 20 of the receiver has a uniform circumference or diameter throughout, which diameter is less than the outer diameter of the ring 16 before being compressed. As the fingers 14 are forced toward each other by the interaction between the fingers and the inner wall 20 of the receiver as the collet with the ring 16 therein is drawn into the receiver by turning of the threaded shaft 4 while the operator grips the handle 2 to hold the receiver against turning, the metal ring 16 is uniformly compressed to a smaller diameter.

Figure 6:
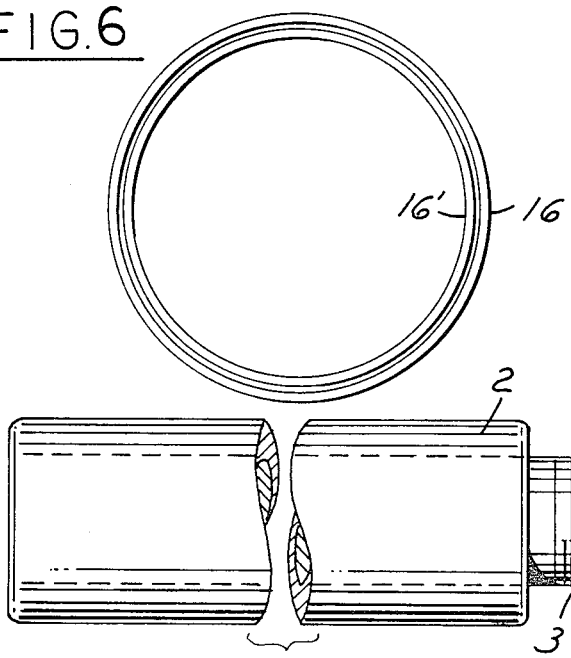
FIG. 6 is an elevation of the ring before it is compressed and after it is compressed.

FIG. 6 shows the ring 16 in its original form as placed in the collet as shown in FIG. 1. At the end of the operation of the tool as shown in FIG. 3, the ring has been uniformly compressed to a smaller diameter and is designated 16'. The original ring 16 and the ring compressed to a smaller diameter 16' is shown in FIG. 6. The final outer diameter of ring 16' will be somewhat less than the internal diameter of the receiver 1.

The ring 16 can be made from any non-resilient material which can be compressed to a smaller diameter such as steel, iron, or any of the other well known metals or alloys commonly used in the manufacture of rings.

After the ring is fully compressed to a smaller diameter as shown in FIG. 3, the threaded shaft 4 is turned in the reverse direction to move the collet and compressed ring out of the receiver 1 whereupon the spring fingers 6 of the collet expand to the position shown in FIG. 4 and the compressed ring with its smaller diameter can now be withdrawn from the collet.

We claim:

1. A tool for compressing a non-resilient metal ring to a smaller diameter comprising in combination a receiver, a threaded shaft mounted in the receiver, a collet having a rotatable connection with the shaft, said receiver being a hollow member into which the collet retreats upon turning of the threaded shaft, means adjacent the ends of the collet fingers when open which receive a ring to be compressed whereby upon turning the threaded shaft the collet is drawn into the receiver and the fingers coact with the inner wall of the receiver to move the fingers of the collet toward closed position and thereby decrease the diameter of the collet and compress the ring to a smaller diameter, and a handle for manually holding the receiver against turning while the threaded shaft is turned to draw the collet into the receiver.

2. A tool for compressing a non-resilient metal ring to a smaller diameter comprising in combination a receiver, a threaded shaft mounted in the receiver, a collet having a rotatable connection with the shaft, said receiver being a hollow member into which the collet retreats upon turning of the threaded shaft, said receiver having an inner wall of substantially uniform diameter, means adjacent the ends of the collet fingers when open which receive a ring to be compressed whereby upon turning the threaded shaft the collet is drawn into the receiver and the fingers coact with the inner wall of the receiver to move the fingers of the collet toward closed position and thereby decrease the diameter of the collet and compress the ring to a smaller diameter, and a handle for manually holding the receiver against turning while the threaded shaft is turned to draw the collet into the receiver.

3. A tool for compressing a non-resilient metal ring to a smaller diameter comprising in combination a receiver, a threaded shaft mounted in the receiver, a collet having a rotatable connection with the shaft, said receiver being a hollow member into which the collet retreats upon turning of the threaded shaft, said receiver having an inner wall of substantially uniform diameter, said threaded shaft extending through a threaded opening in the end wall of the receiver, means adjacent the ends of the collet fingers when open which receive a ring to be compressed whereby upon turning the threaded shaft the collet is drawn into the receiver and the fingers coact with the inner wall of the receiver to move the fingers of the collet toward closed position and thereby decrease the diameter of the collet and compress the ring to a smaller diameter, and a handle for manually holding the receiver against turning while the threaded shaft is turned to draw the collet into the receiver.

4. A tool for compressing a non-resilient metal ring to a smaller diameter comprising in combination a receiver, a threaded shaft mounted in the receiver, a collet having a rotatable connection with the shaft, said receiver being a hollow member into which the collet retreats upon turning of the threaded shaft, said receiver having an inner wall of substantially uniform diameter, said threaded shaft extending through a threaded opening in the end wall of the receiver, means adjacent the ends of the collet fingers when open which receive a ring to be compressed whereby upon turning the threaded shaft the collet is drawn into the receiver and the fingers coact with the inner wall of the receiver to move the fingers of the collet toward closed position and thereby decrease the diameter of the collet and compress the ring to a smaller diameter, and a handle for manually holding the receiver against turning while the threaded shaft is turned to draw the collet into the receiver, the external diameter of the collet fingers when open and without the receiver being greater than the inner diameter of the receiver.

* * * * *